US005905435A

United States Patent [19]

Copeland et al.

[11] Patent Number: 5,905,435

[45] Date of Patent: May 18, 1999

[54] APPARATUS FOR DEACTIVATING MAGNETOMECHANICAL EAS MARKERS AFFIXED TO MAGNETIC RECORDING MEDIUM PRODUCTS

[75] Inventors: Richard L. Copeland; Kevin R. Coffey, both of Boca Raton, Fla.

[73] Assignee: Sensormatic Electronics Corporation, Boca Raton, Fla.

[21] Appl. No.: 08/801,489

[22] Filed: Feb. 18, 1997

[51] Int. Cl.[6] ..... G08B 13/14

[52] U.S. Cl. ..... 340/572.3; 335/284; 343/742; 340/572.1

[58] Field of Search ..... 340/572, 551; 343/742; 335/284

[56] References Cited

U.S. PATENT DOCUMENTS

| | | | |
|---|---|---|---|
| 4,160,978 | 7/1979 | DuHamel | 343/742 |
| 4,184,163 | 1/1980 | Woodward | 343/742 |
| 4,510,489 | 4/1985 | Anderson, III et al. | 340/572 |
| 5,142,292 | 8/1992 | Chang | 343/742 |
| 5,225,807 | 7/1993 | Zhou et al. | 335/284 |
| 5,341,125 | 8/1994 | Plonsky et al. | 340/572 |
| 5,404,147 | 4/1995 | Drucker et al. | 343/742 |
| 5,477,202 | 12/1995 | Zarembo et al. | 340/572 |
| 5,499,015 | 3/1996 | Winkler et al. | 340/572 |
| 5,594,420 | 1/1997 | Copeland et al. | 340/572 |

*Primary Examiner*—Jeffery A. Hofsass
*Assistant Examiner*—John Tweel, Jr.
*Attorney, Agent, or Firm*—Robin, Blecker & Daley

[57] ABSTRACT

A coil array for an EAS marker deactivation device is formed of three co-planar "pancake" coils energized by an a.c. drive signal and arranged to provide significant alternating magnetic fields in each of two orthogonal, horizontal directions. The coil geometry and arrangement are selected to provide smooth field distribution to minimize the possibility of harm to video and audio tapes and other magnetic medium products.

26 Claims, 2 Drawing Sheets

APPARATUS FOR DEACTIVATING MAGNETOMECHANICAL EAS MARKERS AFFIXED TO MAGNETIC RECORDING MEDIUM PRODUCTS

FIELD OF THE INVENTION

This invention relates generally to electronic article surveillance (EAS) and pertains more particularly to so-called "deactivators" for rendering EAS markers inactive.

BACKGROUND OF THE INVENTION

It has been customary in the electronic article surveillance industry to apply EAS markers to articles of merchandise. Detection equipment is positioned at store exits to detect attempts to remove active markers from the store premises, and to generate an alarm in such cases. When a customer presents an article for payment at a checkout counter, a checkout clerk deactivates the marker by using a deactivation device provided to deactivate the marker.

One well-known type of marker (disclosed in U.S. Pat. No. 4,510,489) is referred as a "magnetomechanical" marker. Magnetomechanical markers include an active element and a bias element. When the bias element is magnetized, it applies a bias magnetic field to the active element which causes the active element to be mechanically resonant at a predetermined frequency upon exposure to an interrogation signal which alternates at the predetermined frequency. The interrogation signal is generated by detecting apparatus, which also detects the resonance of the marker which is induced by the interrogation signal.

Magnetomechanical markers may be deactivated by exposing the bias element to an alternating magnetic field of sufficient magnitude to degauss the bias element. After the bias element is degaussed, the marker's resonant frequency is substantially shifted from the predetermined frequency, and the marker's response to the interrogation signal is at too low an amplitude for detection by the detecting apparatus. One known type of deactivation device includes one or more coils energized by an alternating current signal to generate the deactivation magnetic field. An example of this kind of deactivator is disclosed in U.S. Pat. No. 5,341,125.

Other known types of deactivating apparatus include one or more arrays of permanent magnets arranged so that the polarities of the magnets are in alternating orientation along the array. The array of magnets provides a magnetic field that alternates in space along the array. When this magnetic field is applied to the bias element, the magnetic domain structure in the bias element is changed so that the bias element no longer provides the bias field required to place the active element in an activated condition. Deactivator devices which include arrays of permanent magnets are disclosed, for example, in U.S. Pat. No. 5,594,420, which has a common inventor and common assignee with the present application.

Both kinds of deactivators are often provided with a housing in the form of a low-profile pad structure having a flat top surface at which markers are presented for deactivation. The so-called "deactivator pads" are a common sight in retail stores.

One factor that may be considered in the design of marker deactivation devices is the possibility that items present in retail stores could be adversely affected by exposure to the magnetic field generated by the marker deactivation devices. Such items include videotapes, audiotapes, computer software diskettes, and particularly such items which have program material pre-recorded thereon. Moreover, credit cards and other bank cards typically have magnetic strips which may be erased or disrupted by the magnetic fields formed by marker deactivation devices.

According to one known approach to this problem, deactivation devices of the kind which include arrays of permanent magnets with alternating polarities are constructed using magnets that are quite small, so that the magnetic field falls off rather drastically with increasing distance from the magnet array. Accordingly, a marker carried on the outside of a tape cassette can be brought close to the magnet array for deactivation, while the magnetic tape inside the cassette is not exposed to a large field. A disadvantage of this approach is the need to bring the marker quite close to the magnet array if successful deactivation is to be assured.

The latter point brings up another design consideration for deactivation devices, namely that the device operate to reliably deactivate markers presented at some distance from the device, and without regard to the orientation of the marker relative to the deactivation device. The susceptibility of the marker bias element to being degaussed by an alternating magnetic field varies considerably depending on the orientation of the bias element relative to the alternating magnetic field. That is, an alternating field which is of sufficient strength to substantially demagnetize the bias element when applied along the length of the bias element may have little or no effect on the state of magnetization of the bias element if applied transversely to the length of the bias element. The problems of deactivating magnetomechanical markers at a distance from the deactivation device, and regardless of the orientation of the marker relative to the deactivation device, are addressed in U.S. patent application Ser. No. 08/794,012, filed Feb. 3, 1997, entitled "Multi-Phase Mode Multiple Coil Distance Deactivator for Magnetomechanical EAS Markers", which has common inventors and a common assignee with the present application. In typical prior art coil-based deactivation devices, an alternating magnetic field having a peak level of 550–600 Oe or more is provided at a top surface of the deactivation device to provide reliable deactivation at the top surface of the device and at some distance above the top surface.

In general, a trade-off must be made between the goal of deactivating magnetomechanical markers at a distance and without regard to marker orientation; on one hand, and avoiding undesirable effects on products which incorporate magnetic media, and credit cards, etc., on the other hand. The goal of deactivating markers at a distance and without regard to marker orientation is becoming particularly important because of the increasingly popular practice of "source tagging", i.e., securing markers to goods during manufacture or during packaging of the goods at a manufacturing plant or distribution facility. In some cases, the markers may be secured to the articles of merchandise in positions on or within the merchandise which make it difficult or impossible to bring the marker into contact with the surface of the deactivation device.

An invention disclosed in U.S. patent application Ser. No. 08/697,629, filed Aug. 28, 1996 (which has the same inventors and the same assignee as the present application), provides prospects for improving the trade off between reliable deactivation of markers and preventing harm to magnetically sensitive articles of merchandise. According to the '629 application, the bias element of a magnetomechanical marker is formed of a material having a lower coercivity than materials conventionally used in bias elements for magnetomechanical markers, so that reliable deactivation may be accomplished with lower field levels than have previously been employed. The disclosure of the '629 application is incorporated herein by reference.

OBJECTS AND SUMMARY OF THE INVENTION

It is a primary object of the present invention to provide devices for deactivating magnetomechanical EAS markers that are particularly suitable for use in video stores and other retail establishments that specialize in products which include magnetic media.

A more particular object of the invention is to provide a deactivator device that minimizes or eliminates potential for adverse effects upon magnetic media products.

It is another object of the invention to provide a deactivation device that operates reliably notwithstanding variations in label orientation.

Yet a further object of the invention is to provide deactivation devices that operate at lower power levels than conventional devices.

It is still a further object of the invention to provide deactivation devices at lower cost than conventional devices.

According to an aspect of the invention, there is provided apparatus for deactivating an electronic article surveillance marker, including three co-planar coils, of which a first and second coil are both circular and are aligned with each other along a first axis, and of which a third coil is displaced from the first and second coils in a direction substantially perpendicular to the first axis. The apparatus further includes circuitry for energizing the coils with an alternating current drive signal.

The third coil also may be substantially circular and the first and second coils may be substantially equal in size to each other. The third coil may be substantially larger than the first and second coils, or the third coil may be substantially the same size as the first and second coils, in which case, preferably, a fourth circular coil is provided aligned with the third coil in the aforesaid direction perpendicular to the first axis, with the fourth coil being substantially equal in size to the first, second and third coils. The three or four coils, as the case may be, may be connected to each other in series and each of the coils is preferably a so-called "pancake coil" which is quite thin in the direction orthogonal to the plane of the coils and is preferably no more than a few turns of wire thick in the direction orthogonal to the plane of the coils.

The apparatus preferably also includes a planar magnetic sheet arranged in a plane parallel to and adjacent to the common plane of the coils. It is also preferable that the first and second coils be energized in phase opposition so as to provide mutually reinforcing currents at a meeting point of the first and second coils.

According to another aspect of the invention, there is provided apparatus for deactivating an electronic article surveillance marker, including a housing having a substantially flat top surface, and a mechanism disposed within the housing for forming a magnetic field for deactivating the marker, the field not exceeding a peak amplitude of 200 Oe at any point on the top surface of the housing. Alternatively, the apparatus according to this aspect of the invention may be constructed according to more stringent criteria which limit the peak amplitude of the deactivation field at any point on the top surface of the housing to no more than 125 Oe, or to no more than 75 Oe.

Deactivation devices provided in accordance with the invention substantially minimize or eliminate any risk of harm to magnetic media products and/or credit cards, while providing reliable deactivation of magnetomechanical markers attached to the magnetic media products when presented at, and in a plane parallel to, the top of the deactivation device, without regard to the orientation of the marker within the horizontal plane. Moreover, the deactivators provided in accordance with the invention operate at low power levels and are unlikely to interfere with nearby video monitors or other electronic equipment, and the deactivators can be produced at low cost.

The foregoing and other objects, features and advantages of the invention will be further understood from the following detailed description of preferred embodiments and from the drawings, wherein like reference numerals identify like components and parts throughout.

DESCRIPTION OF PREFERRED EMBODIMENTS

A first embodiment of the invention will now be described with reference to FIGS. 1–3.

Figure 1:
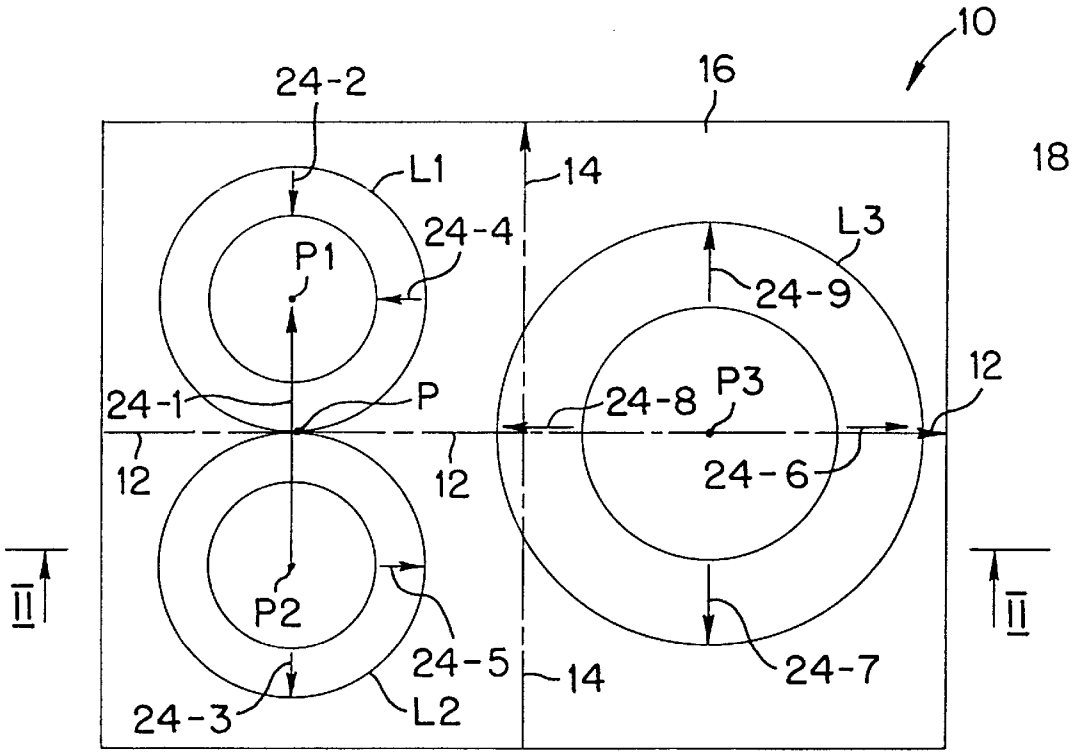
FIG. 1 is a plan view, with housing cover removed, of a marker deactivation device provided according to an aspect of the invention.

FIG. 1 is a plan view of a deactivation device 10 provided in accordance with the invention. The device 10 is presented in FIG. 1 in somewhat schematic terms, in that the device 10 is shown without the housing cover being present, and without explicitly showing power circuitry or electrical connections among elements of the device.

The device 10 includes an array of coils made up of coils L1, L2 and L3. The coils L1–L3 are all substantially planar and circular and are arranged in a common plane.

Also shown in FIG. 1 are an X-direction axis represented by dash-line arrow 12 and a Y-direction axis perpendicular to the X-direction axis and represented by dash-line arrow 14.

It is seen from FIG. 1 that coils L1 and L2 are aligned with each other along an axis parallel to the Y-direction axis. Coils L1 and L2 are also arranged so as to be quite close to each other, or even touching, so as to form a point of common tangency P. Preferably, the coils L1 and L2 are substantially equal to each other in size. Coil L3, as shown in FIG. 1, is substantially larger than coils L1 and L2 and is displaced in the X direction from coils L1 and L2. Both a central point P3 of the coil L3 and the meeting point P of coils L1 and L2 are shown as falling substantially on the X-direction axis.

In a preferred embodiment, each of the coils L1 and L2 has an inner radius (distance from central point P1 or P2 to inner perimeter of coil) of about 1.0 in., and an outer radius (central point to outer perimeter of coil) of about 1.6 in. The inner radius of coil L3 (distance from central point P3 to inner perimeter of coil L3) is about 1.5 in., and the outer radius is about 2.7 in. The center-to-center distance from coil L3 to either of the smaller coils L1 and L2 is about 5.5 in., to produce a closest distance from the perimeter of coil L3 to the perimeter of either one of the smaller coils L1 or L2 of about 1 in.

Preferably, all of the coils L1–L3 are in the form of "pancake" coils. As is understood by those of ordinary skill in the art, "pancake" coils exhibit a very low profile, with a thickness in the direction orthogonal to the plane of the coil equal to about 10% or less of the difference between the outer and inner radii of the coil. Such a configuration may be achieved by winding the coil so that no more than three turns are stacked vertically. It is also desirable that the thickness of the coils be substantially uniform throughout the coil so as to minimize variations in distribution of the magnetic field generated by the coils. A preferred embodiment of the coils L1–L3 is formed with 28-gauge magnet wire.

The coils L1–L3 are supported on a substantially planar magnetic steel sheet 16 which functions as a magnetic shield. The steel sheet 16 may be formed, for example, of 0.020 inch thick 430 stainless steel. Although shown as substantially rectangular in FIG. 1, the steel sheet 16 may take other forms. For example, in a preferred embodiment of the invention, the steel sheet 16 is generally pear-shaped in outline and has an outer outline that is adapted to overlap with the coil array and extend only a short distance beyond the outer perimeters of the coils, with a somewhat narrow "waist" region at the area between the large coil L3 and the smaller coils L1 and L2.

Figure 2:
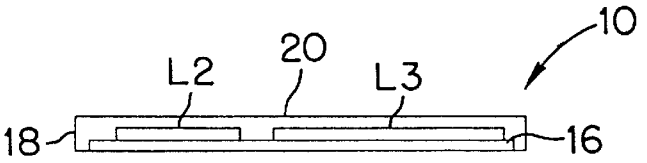
FIG. 2 is a cross-sectional side view of the deactivation device of FIG. 1, taken as indicated at II—II in FIG. 1.

As seen from FIG. 2, the coil array and the metal sheet 16 are contained within a housing 18. The housing may be formed of molded plastic, e.g., and includes a substantially flat top surface 20 at or near which markers are to be presented for deactivation. As suggested by FIG. 1, the top surface 20 is longer in the X direction than in the Y direction.

Figure 3:
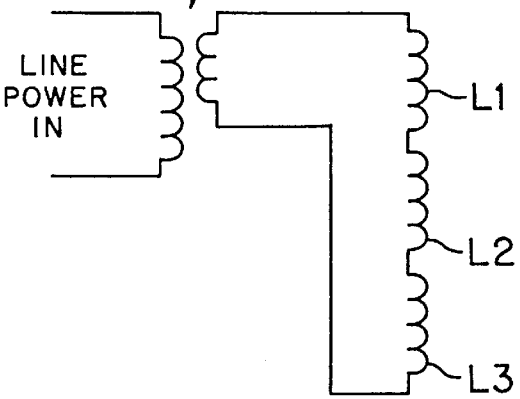
FIG. 3 is a schematic representation of electrical components of the deactivation device of FIG. 1.

A preferred arrangement for energizing the coil array is schematically illustrated in FIG. 3. As seen from FIG. 3, the coils L1, L2 and L3 are connected in series and are driven by an a.c. driving signal derived by a step-down transformer 22 from a standard power signal such as 120V, 60 Hz. In a preferred embodiment of the invention, the driving signal has a maximum amplitude of 16V and the coils have impedances that limit the current to well under 0.5 A (for example), so that the level of power consumed by the deactivation device is low.

Coils L1 and L2 are connected so that the driving signal is provided in phase opposition in coils L1 and L2. As a result, the respective currents in coils L1 and L2 are substantially reinforcing of each other at or near the point P and the reinforcing currents at that point generate a strong magnetic field in the Y direction, as indicated by the arrow 24-1. The arrows labeled 24-2 through 24-9 are indicative of orientations of the magnetic field produced by the coil array at the respective locations of the arrows.

In operation, the driving signal is continuously applied to the coils L1, L2 and L3, and an article of merchandise bearing a marker to be deactivated is swept along the locus represented by the X-direction axis (dash-line arrow 12) in proximity to the top surface 20 of the housing 18 of the deactivation device 10. As shown in FIG. 1, a marker swept along the X-direction axis encounters a strong Y-direction magnetic field represented by the arrow 24-1, and also encounters significant X-direction fields generated by the large coil L3 and represented by the arrows 24-6 and 24-8. A marker in a horizontal orientation swept along the X-direction axis is exposed to a substantial magnetic field oriented along the length of the marker, regardless of the orientation of the marker within a plane parallel to the top surface of the deactivation device.

It is preferred that the deactivation device 10 be employed in conjunction with magnetomechanical markers which include bias elements formed of low-coercivity materials of the type disclosed in the above-mentioned application Ser. No. 08/697,629. One such material is designated as "MagnaDur 20-4", commercially available from Carpenter Technology Corporation, Reading, Pa. It is preferred that the driving signal be at an amplitude such that the magnetic field generated by the coil array is sufficiently strong to reliably deactivate a marker having a low-coercivity bias element and swept along the X-direction axis in a horizontal orientation at a distance of up to about 10 millimeters above the top surface 20 of the deactivation device 10, regardless of the orientation of the marker relative to the X and Y directions.

It is another significant feature of the present invention that the coils L1–L3 are shaped and arranged so as to minimize localized peaks in the magnetic field produced by the coil array, thereby minimizing or eliminating the risk that magnetic media products and/or credit cards may be harmed by the magnetic field produced by the deactivation device. The round, flat shape of the coils tends to avoid the field peaks that are typically generated by coils that are square in shape or have corners that produce localized field peaks.

Preferably the driving signal is provided at a level such that the magnetic field generated by the coil array does not exceed a peak level of 75 Oe at any point on the top surface 20 of the housing 18 of the deactivation device. The 75 Oe level is considered an acceptable level of exposure that will not cause degradation to a pre-recorded or blank audiotape, or to other types of magnetic medium product. The 75 Oe level is also considered safe for credit cards.

If a larger effective deactivation distance above the top surface 20 is desired, it is contemplated to provide a driving signal at a level such that the peak magnetic field at all points of the top surface 20 does not exceed 125 Oe. This level is considered safe for videotapes and credit cards, although possibly undesirable for other magnetic medium products. Operation at a still higher current level, but such that the peak magnetic field does not exceed 200 Oe at any point on the top surface 20, is also contemplated. The 200 Oe level is considered safe for videotapes.

The shape of the coils also causes the magnetic field to fall off quite gradually with increasing distance above the deactivator 10, to produce the desirable combination of reliable deactivation at a distance from the device and compatibility with magnetic media products. If one of the low-coercivity bias materials referred to above is employed in a magnetomechanical marker, the marker can be reliably deactivated by applying an alternating field having a peak level of about 25 Oe.

Figure 4:
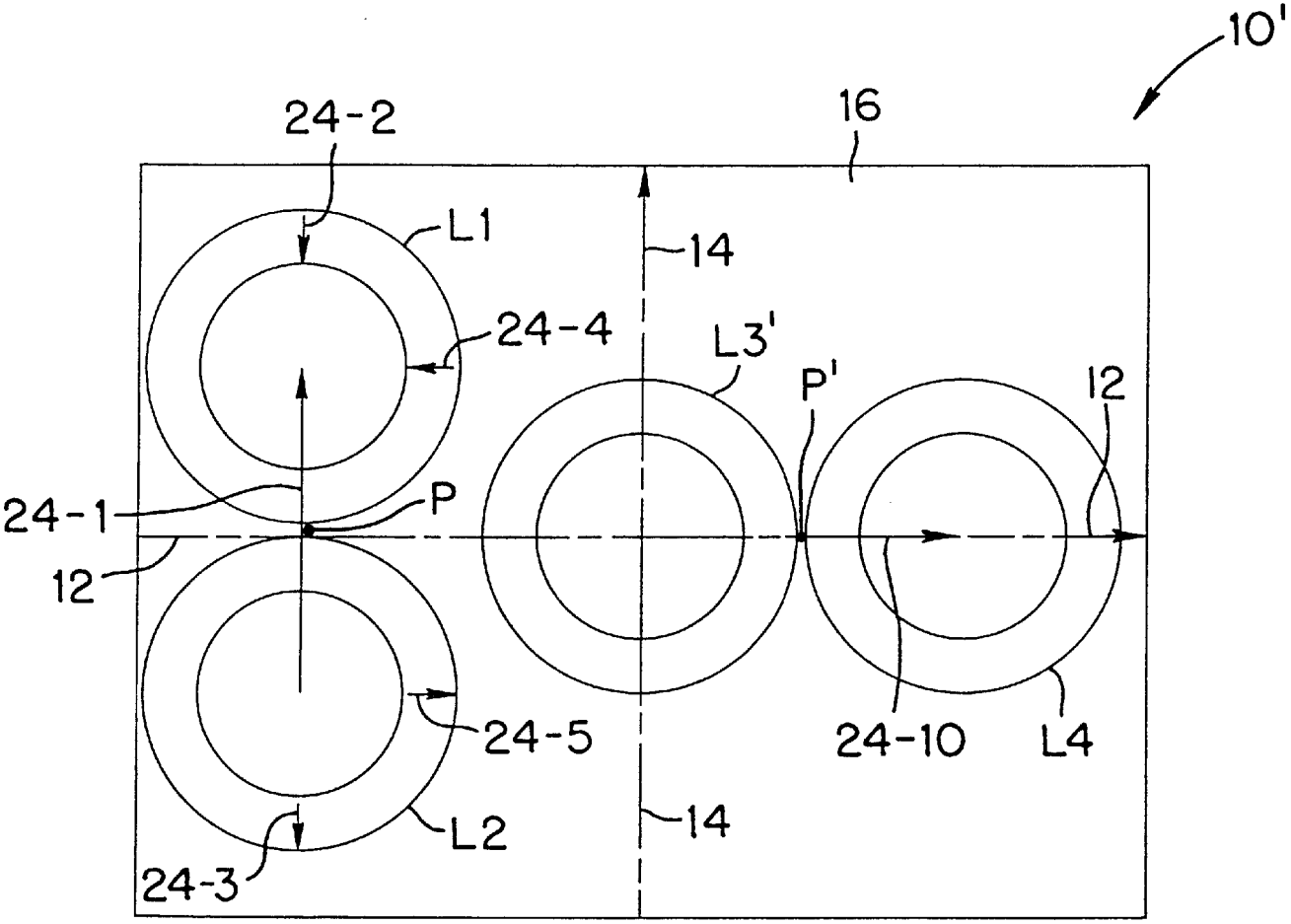
FIG. 4 is a plan view, with housing cover removed, of another embodiment of the marker deactivation device.

An alternative embodiment of the invention is shown as deactivation device 10' in FIG. 4. In the embodiment of FIG. 4, coils L3' and L4 are substituted for the coil L3 shown in FIG. 1. As seen from FIG. 4, the coils L3' and L4 are substantially the same size as, and otherwise substantially identical to, coils L1 and L2. Coils L3' and L4 are displaced from coils L1 and L2 in the X direction, and are aligned with each other along the X-direction axis. All four coils are connected in series, and the connection between coils L3' and L4 is made so that the two coils are excited in phase opposition. Consequently, the respective currents flowing through coils L3' and L4 are mutually reinforcing at and near a point P' where the respective outer perimeters of the coils meet or closely approach each other. The coils L3' and L4 therefore generate a strong magnetic field in the X direction at and near point P', as indicated by the arrow 24-10. It will be understood that a marker swept along the X-direction axis in proximity to the top surface of the deactivation device 10' of FIG. 4 will encounter both the strong Y-direction field represented by arrow 24-1 and the strong X-direction field represented by the arrow 24-10. As in the embodiment of FIG. 1, the coils shown in FIG. 4 have a geometry that tends to minimize undesirable magnetic field peaks, and therefore to prevent harm to magnetic media products.

Another advantage of the deactivation devices provided in accordance with the invention is the relatively simple drive circuitry, which can be produced at low cost. Moreover, because the drive circuitry operates continuously, there is no need for marker detection and drive pulse triggering circuits which have been provided in conventional deactivation devices.

Although it is preferred that the drive circuitry be operated continuously, it is also contemplated that the drive signal be provided in pulses at regular, short intervals, and with a substantial duty cycle.

Various other changes in the foregoing deactivation devices may be introduced without departing from the invention. The particularly preferred embodiments of the invention are thus intended in an illustrative and not limiting sense. The true spirit and scope of the invention is set forth in the following claims.

What is claimed is:

1. Apparatus for deactivating an electronic article surveillance marker, comprising:

first, second and third co-planar coils, said first and second coils both being circular and aligned with each other along a first axis, and the third coil being displaced from said first and second coils in a direction substantially perpendicular to said first axis; and means for energizing said coils with an alternating current drive signal to generate an alternating magnetic field for deactivating the electronic article surveillance marker.

2. Apparatus according to claim 1, wherein said third coil is substantially circular.

3. Apparatus according to claim 2, wherein said first and second coils are substantially equal in size.

4. Apparatus according to claim 3, wherein a central point of said third coil is substantially aligned, in said direction substantially perpendicular to said first axis, with a meeting point of said first and second coils.

5. Apparatus according to claim 4, wherein said third coil is substantially larger than said first and second coils.

6. Apparatus according to claim 3, further comprising a fourth circular coil, aligned with said third coil in said direction perpendicular to said first axis.

7. Apparatus according to claim 6, wherein said third and fourth coils are substantially equal in size to said first and second coils.

8. Apparatus according to claim 6, wherein said third and fourth coils are energized so as to have respective alternating currents that are in phase opposition.

9. Apparatus according to claim 8, wherein said first and second coils are energized so as to have respective alternating currents that are in phase opposition.

10. Apparatus according to claim 1, wherein said first and second coils are energized so as to have respective alternating currents that are in phase opposition.

11. Apparatus according to claim 1, wherein said three coils are connected to each other in series.

12. Apparatus according to claim 1, wherein each of said three coils is a pancake coil.

13. Apparatus according to claim 1, further comprising a planar magnetic sheet arranged in a plane parallel and adjacent to a common plane of said coils.

14. Apparatus for deactivating an electronic article surveillance marker, comprising:

three co-planar circular coils; and means for energizing said coils with an alternating current drive signal to generate an alternating magnetic field for deactivating the electronic article surveillance marker.

15. Apparatus according to claim 14, wherein each of said three coils is a pancake coil.

16. Apparatus for deactivating an electronic article surveillance marker, comprising:

a housing having a substantially flat top surface; and field means disposed within said housing for forming a magnetic field for deactivating said marker; said field not exceeding a peak amplitude of 200 Oe at any point on said top surface of said housing.

17. Apparatus according to claim 16, wherein said magnetic field does not exceed a peak amplitude of 125 Oe at any point on said top surface of said housing.

18. Apparatus according to claim 17, wherein said magnetic field does not exceed a peak amplitude of 75 Oe at any point on said top surface of said housing.

19. Apparatus according to claim 16, wherein said field means comprises a plurality of coils energized by an alternating current.

20. Apparatus according to claim 19, wherein said plurality of coils includes three co-planar pancake coils.

21. Apparatus according to claim 20, wherein said plurality of coils includes four co-planar pancake coils.

22. A method of deactivating a magnetomechanical EAS marker, comprising the steps of:

providing a deactivation device having a substantially flat top surface and three co-planar circular coils disposed under said top surface for generating an alternating magnetic field at said top surface; and sweeping said magnetomechanical marker across said top surface of said deactivation device in said alternating magnetic field within a predetermined distance above said deactivation device.

23. A method according to claim 22, wherein said top surface of said deactivation device has a first dimension in a first horizontal direction and a second dimension shorter than said first dimension in a second horizontal direction perpendicular to said first direction, and said sweeping step includes sweeping said marker in said first direction across said top surface.

24. A method of deactivating a magnetomechanical EAS marker, comprising the steps of:

providing a deactivation device having a substantially flat top surface and a coil array disposed under said top surface for generating an alternating magnetic field at said top surface, said alternating magnetic field having a peak amplitude that does not exceed 200 Oe at any point on said top surface of the deactivation device; and sweeping said magnetomechanical marker across said top surface of said deactivation device within a predetermined distance above said deactivation device.

25. A method according to claim 24, wherein said alternating magnetic field has a peak amplitude that does not exceed 125 Oe at any point on said top surface of the deactivation device.

26. A method according to claim 25, wherein said alternating magnetic field has a peak amplitude that does not exceed 75 Oe at any point on said top surface of the deactivation device.

* * * * *